United States Patent [19]

Child et al.

[11] 4,391,762

[45] Jul. 5, 1983

[54] AERATED DRINKS MACHINE

[75] Inventors: Robert P. Child; Barry G. Charles, both of Hampshire, England

[73] Assignee: Thorn Emi Domestic Electrical Appliances Limited, London, England

[21] Appl. No.: 339,684

[22] Filed: Jan. 15, 1982

[30] Foreign Application Priority Data

Jan. 16, 1981 [GB] United Kingdom ..... 8101415

[51] Int. Cl.[3] ..... B01F 3/04

[52] U.S. Cl. ..... 261/121 R; 99/323.1; 261/DIG. 7; 426/477

[58] Field of Search ..... 426/477; 261/121 R, 261/122–124, 70, 64 B, DIG. 7; 99/275, 323.1

[56] References Cited

U.S. PATENT DOCUMENTS

| | | | |
|---|---|---|---|
| 2,591,990 | 4/1952 | Wisdom | 261/DIG. 7 |
| 2,906,624 | 9/1959 | Deren | 99/323.1 X |
| 3,233,779 | 2/1966 | Cornelius | 426/477 X |
| 3,674,244 | 7/1972 | Garavelli | 261/DIG. 7 |
| 4,187,262 | 2/1980 | Fessler et al. | 99/275 X |
| 4,222,972 | 9/1980 | Caldwell | 261/121 R |
| 4,251,473 | 2/1981 | Gilbey | 261/121 R X |
| 4,298,551 | 11/1981 | Adolfsson et al. | 261/64 B X |

FOREIGN PATENT DOCUMENTS

| | | | |
|---|---|---|---|
| 3011106 | 11/1980 | Fed. Rep. of Germany | 426/477 |
| 1453363 | 10/1976 | United Kingdom . | |
| 2026882 | 2/1980 | United Kingdom . | |

*Primary Examiner*—Richard L. Chiesa

*Attorney, Agent, or Firm*—Fleit, Jacobson & Cohn

[57] ABSTRACT

An appliance for making an aerated beverage, in which a container of pressurized liquid carbon dioxide is mounted on a connection in a casing, the casing being mounted thereon, a housing for a bottle partly filled with water, means for supporting the bottle in the housing, a nozzle communicating with the carbon dioxide container and a stopper for engaging in the neck of the bottle. A manually operable valve is provided to allow carbon dioxide to enter the nozzle so that it is dissolved in the water. A displacement body on the nozzle is provided so that when a partly filled bottle is introduced with the nozzle therein, the level of the water rises so that only a small amount of air is left above the water in the bottle, thus reducing the wastage of carbon dioxide.

4 Claims, 1 Drawing Figure

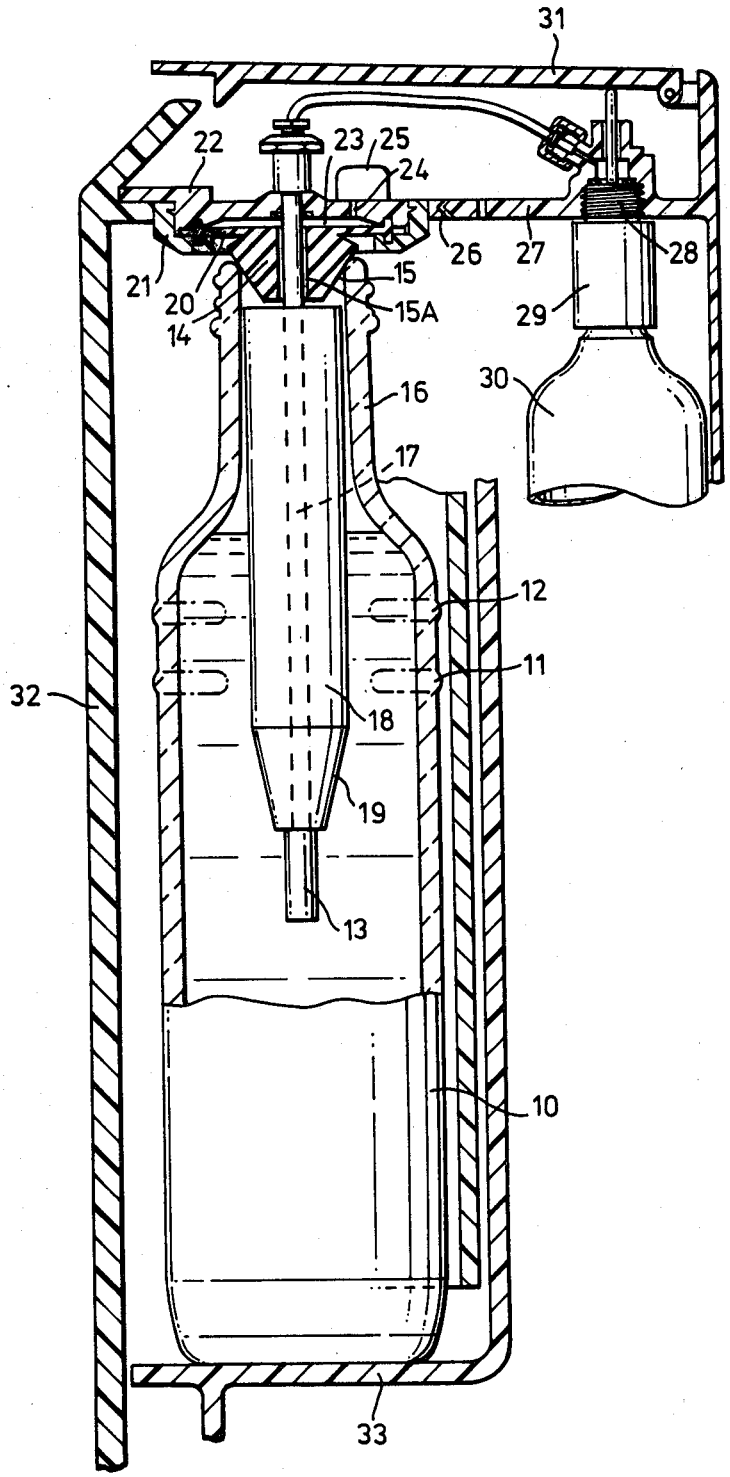
31
22
23
25
24
26
27
28
21
20
14
15
15A
29
30
16
17
12
11
32
18
19
13
10
33

AERATED DRINKS MACHINE

DESCRIPTION

The present invention relates to an appliance for making an aerated beverage.

One form of device for making an aerated beverage, for example, such as is described in British Pat. No. 1453367 and also in an Application published under No. 2026882 includes a casing, in which is enclosed a container of pressurized liquid carbon dioxide and, connected thereto by a manually operable valve, an elongate nozzle which is either permanently angled downwardly and forwardly or is pivotally pivotable between such a position and vertical position. The bottle which is partly filled with water is moved upwardly relative to the nozzle, so that the nozzle is immersed in the water, with the nozzle in the inclined position. The bottle is held in position with its neck against the stopper at the top of the nozzle usually after pivoting the nozzle to the vertical position. The appliance also usually includes a shatterproof housing which surrounds the bottle when it is in position around the nozzle.

The manually operated valve is actuated a few times and carbon dioxide gas is thus introduced into the water. A safety valve is provided which releases any excess pressure which may occur in the bottle. The bottle is then removed from the appliance and its contents are either used in this form as soda water, or a concentrate flavouring syrup is added to obtain an aerate beverage, such as lemonade, tonic water, cola etc.

Such an apparatus is generally satisfactory but the amount of carbon dioxide used can be in excess of that which is necessary to aerate the beverage. The reason for this is that it is customary for the bottle to be filled with water to a level so that the water occupies about three quarters of the total volume of the bottle. This reduces the chance of the mixture of the aerated water and syrup effervescing over the neck of the bottle which would clearly be both wasteful and messy. The space above the water, however, becomes filled with pressurized carbon dioxide which is subsequently wasted when the bottle is removed from the stopper.

It is now proposed, according to the present invention, for the appliance to have, associated with the nozzle, a displacement body which is capable of being passed into the neck of the bottle and which will displace a significant volume of air and/or water, so that when the bottle is in position, with the nozzle and displacement body therein, the level of the water is such as to leave only a small volume of air thereabove.

The displacement body could, for example, take the form of a plastic body, e.g. injection moulded or extruded, which extends over a substantial length of the nozzle and has an upper portion which nearly seals in the neck of the bottle, the lower portion of the body below the neck of the bottle displacing an amount of water to the foot of the neck.

In order that the present invention may more readily be understood, the following description is given, merely by way of example, reference being made to the accompanying drawing, in which the sole FIGURE is a schematic view of a bottle with the nozzle of an appliance according to the invention therein, the neck of the bottle being sealed by a rubber seal.

Referring to the drawing, the bottle is indicated by the general reference numeral 10 and includes a lower bead 11 which is intended to indicate the level to which the water should normally be introduced, and an upper bead 12 which indicates the further level which the water should take when the flavouring concentrate has been added.

Shown extending into the bottle is the nozzle 13 provided with a standard form of bottle seal 14 which can be engaged in the opening 15 in the neck 16 of the bottle. This stopper 14 may be forced into the neck of the bottle, for example, by an arrangement which may be of the type described in British Patent No. 1453363, or preferably, as illustrated, the stopper itself may be lowered due to the pressure of the carbon dioxide, as for example shown in British Specification No. 2026882.

As can be seen from the drawing the stopper 14 is mounted on a diaphragm 20 which is clamped between the parts 21 and 22 of the casing of the bottle to leave above the diaphragm a space 23 which communicates via an opening 24 with an over pressure valve 25. The part 22 is connected by a solid hinge 26, a portion 27 of the casing of the appliance which carries a connection 28 for mounting a manually operable release valve 29, on which is mounted a container 30 of pressurized carbon dioxide. Valve 28 can be operated by a pivotal lever 31. Surrounding the bottle is a shatterproof housing 32 and the bottle itself is mounted on a support foot 33 forming part of the casing.

As can be seen the stem 17 of the nozzle is surrounded by a displacement body 18 of generally cylindrical configuration at its upper end and a tapered configuration 19 at its lower end.

The diameter of the cylindrical section 18 is marginally less than the internal diameter of the neck 16 of the bottle.

In use, the bottle is filled to the level of the bead 11, that is about three quarters full, so that a substantial space is left thereabove. When the bottle is introduced into the appliance with the bottle 13 extending through the neck of the bottle into the water, the displacement body 18, 19, displaces the air and raises the level of the water to about the level of the bead 12 or higher so that there is only a very small volume of air left above the water.

When the lever 31 is operated the valve 29 is opened and gas flows via nozzle 13 into the liquid and some of it bubbles up and escapes through the annular space between the nozzle and the aperture **15*a* in the stopper, into the space 23**, thus forcing the stopper into the bottle, because the area of the diaphragm is greater than the projected area of the stopper.

When carbon dioxide is introduced through the nozzle 13, there is very little air above the level of the water for the carbon dioxide to dissipate into. Thus, substantially more of the carbon dioxide is dissolved in the water and there is less wastage. It has been found that this arrangement can produce a saving of 10%, and even more, as compared with a conventional appliance in which the body 18, 19 is not included.

We claim:

1. An appliance for making an aerated beverage, said appliance comprising, in combination:

(a) a casing;

(b) a connection carried by the casing for mounting a container of pressurized liquid carbon dioxide;

(c) a housing for a bottle of water carried by said casing;

(d) a nozzle communicating with said connection and extending downwardly within said housing;

(e) a stopper positioned effective to engage in the neck of a bottle mounted within said housing;

(f) means for supporting the bottle in the housing so that the stopper is engaged therein;

(g) a manually operable valve selectively allowing carbon dioxide to flow from a container mounted on said connection to said nozzle;

(h) a safety pressure valve connected to the interior of the bottle when the stopper is engaged in its neck; and (i) a displacement body associated with said nozzle and capable of being passed into the neck of the bottle, said displacement body displacing a significant volume of air and/or of water, whereby when a bottle partly filled with water is in position, and the nozzle and displacement body are therein, the level of the water is such as to leave only a small volume of air thereabove and around the displacement body.

2. An appliance as claimed in claim 1, wherein the displacement body extends over a substantial length of the nozzle and comprises an upper portion which nearly seals in the neck of the bottle, and a lower portion below the neck of the bottle positioned to displace an amount of water at the foot of the neck.

3. An appliance as claimed in claim 2, wherein the displacement body is formed of a plastics material and is injection-moulded or extruded.

4. An appliance as claimed in claim 2, wherein the displacement body comprises a generally cylindrical configuration at its upper end and a tapered configuration at its lower end.

* * * * *